US010953286B2

(12) United States Patent
Sato et al.

(10) Patent No.: US 10,953,286 B2
(45) Date of Patent: Mar. 23, 2021

(54) GOLF BALL

(71) Applicant: Bridgestone Sports Co., Ltd., Tokyo (JP)

(72) Inventors: Katsunori Sato, Saitamaken (JP); Kae Iizuka, Saitamaken (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 16/723,415

(22) Filed: Dec. 20, 2019

(65) Prior Publication Data

US 2020/0206579 A1 Jul. 2, 2020

(30) Foreign Application Priority Data

Dec. 27, 2018 (JP) ..... 2018-245577

(51) Int. Cl.
*A63B 37/06* (2006.01)
*A63B 37/00* (2006.01)

(52) U.S. Cl.
CPC ..... *A63B 37/0092* (2013.01); *A63B 37/0043* (2013.01); *A63B 37/0062* (2013.01); *A63B 37/0072* (2013.01)

(58) Field of Classification Search
CPC ..... A63B 37/0078; A63B 37/0061; A63B 37/0041; A63B 37/003
USPC ..... 473/376
See application file for complete search history.

(56) References Cited

U.S. PATENT DOCUMENTS

| | | | | |
|---|---|---|---|---|
| 2003/0158000 | A1* | 8/2003 | Kennedy, III | A63B 37/06 473/371 |
| 2009/0042670 | A1 | 2/2009 | Ohama | |
| 2009/0042671 | A1 | 2/2009 | Ohama | |
| 2015/0258388 | A1* | 9/2015 | Watanabe | C08K 5/098 473/373 |

FOREIGN PATENT DOCUMENTS

| | | |
|---|---|---|
| JP | 2003-39233 A | 2/2009 |
| JP | 2009-39230 A | 2/2009 |

* cited by examiner

*Primary Examiner* — Raeann Gorden
(74) *Attorney, Agent, or Firm* — Sughrue Mion, PLLC

(57) ABSTRACT

A golf ball for amateur golfers exhibits excellent flight characteristics when hit by the average golfer and also has a good feel at impact that is both soft and solid. The golf ball includes a core, an intermediate layer and a cover, and has coefficient of restitution and compressive deformation relationships that satisfy specific conditions.

12 Claims, 1 Drawing Sheet

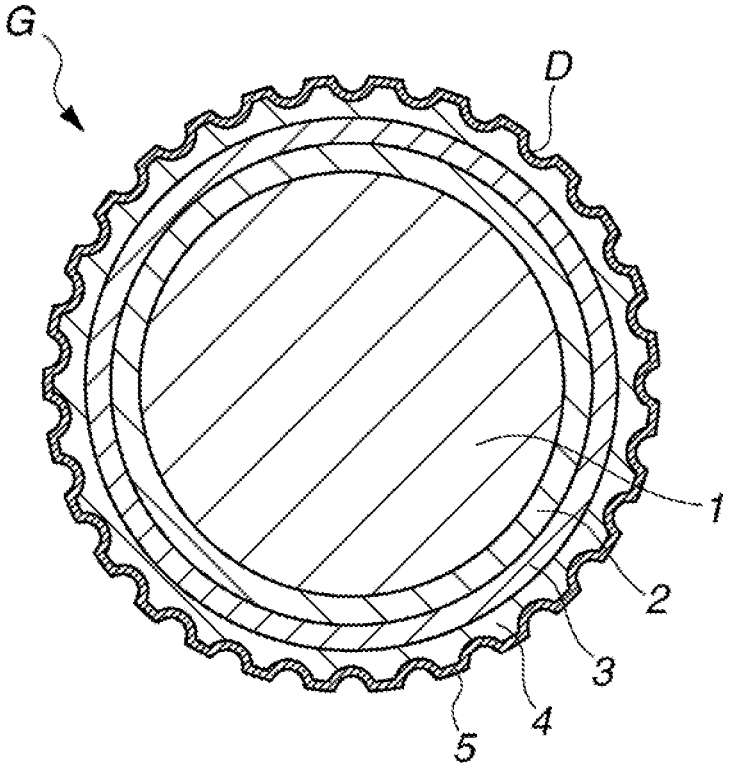
G
D
1
2
3
4
5

GOLF BALL

CROSS-REFERENCE TO RELATED APPLICATION

This non-provisional application claims priority under 35 U.S.C. § 119(a) on Patent Application No. 2018-245577 filed in Japan on Dec. 27, 2018, the entire contents of which are hereby incorporated by reference.

TECHNICAL FIELD

The present invention relates to a golf ball having a core, an intermediate layer and a cover which is intended for use by amateur golfers lacking a fast head speed.

BACKGROUND ART

In the golf ball market for amateur golfers, numerous balls intended to satisfy amateur golfers in terms of flight performance and feel at impact have hitherto been developed. To this end, various functional multi-piece solid golf balls have been disclosed in which the ball has a multilayer structure and the core, intermediate layer and cover (outermost layer) each have optimized surface hardnesses.

In addition, art concerning the coefficient of restitution for spheres such as golf balls and golf ball cores has been disclosed in, for example, JP-A 2009-39230 and JP-A 2009-29233.

This prior art, which relates to the coefficient of restitution for spheres such as golf balls and golf ball cores, computes the coefficient of restitution for these spheres when struck with a hollow aluminum cylinder at a velocity of 40 m/s.

However, there exists a desire to optimize the coefficient of restitution and the deformation at ball incident velocities typical of golfers who hit in, more specifically, the low to medium head speed range. Also, in order to obtain a better feel at impact that is solid and soft, there is a need as well to optimize the coefficients of restitution for these spheres at more specific given incident velocities.

SUMMARY OF THE INVENTION

It is therefore an object of the present invention to provide a golf ball for amateur golfers which has an excellent flight when hit by the average golfer whose head speed is not that high and which also has a good feel at impact that is soft and solid on full shots with all golf club numbers.

As a result of extensive investigations, we have discovered that by designing a golf ball having a core, an intermediate layer and a cover in such a way that, letting LBS, MBS and HBS be the respective coefficients of restitution (COR) for the golf ball at incident velocities of 35 m/s, 45 m/s and 55 m/s and letting LMS, MMS and HMS be the respective coefficients of restitution (COR) for the sphere obtained by encasing the core with the intermediate layer (intermediate layer-encased sphere) at incident velocities of 35 m/s, 45 m/s and 55 m/s, the relationship between these COR values and the compressive deformation (BC) in millimeters when the core is compressed under a given load satisfies formulas (1) and (2) below:

$$5.10 \leq (LBS+MBS) \times BC \leq 5.50 \quad (1)$$

$$5.10 \leq (LMS+MMS) \times BC \leq 5.50 \quad (2)$$

(with the proviso that LBS≥0.820 and LMS≥0.820), golfers lacking a fast head speed are fully able to obtain a satisfactory flight performance on shots with all golf clubs, including drivers (W #1) and irons, and are also able to obtain a feel at impact that is both soft and solid on full shots with all golf club numbers.

Accordingly, the invention provides a golf ball which includes a core, an intermediate layer and a cover wherein, letting LBS, MBS and HBS be the respective coefficients of restitution for the ball at incident velocities of 35 m/s, 45 m/s and 55 m/s, LMS, MMS and HMS be the respective coefficients of restitution for the sphere obtained by encasing the core with the intermediate layer (intermediate layer-encased sphere) at incident velocities of 35 m/s, 45 m/s and 55 m/s and BC be the compressive deformation (mm) of the ball when compressed under a final load of 1,275 N (130 kgf) from an initial load of 98 N (10 kgf), the ball satisfies formulas (1) and (2) below:

$$5.10 \leq (LBS+MBS) \times BC \leq 5.50 \quad (1)$$

$$5.10 \leq (LMS+MMS) \times BC \leq 5.50 \quad (2)$$

with the proviso that LBS≥0.820 and LMS≥0.820.

In a preferred embodiment of the golf ball of the invention, letting LCS be the coefficient of restitution for the core at an incident velocity of 35 m/s, LCS≤0.815.

In another preferred embodiment of the golf ball, letting MCS be the coefficient of restitution for the core at an incident velocity of 45 m/s, MCS≤0.756. In this preferred embodiment, the golf ball may satisfy formula (5) below:

$$5.00 \leq (MCS+LCS) \times BC \leq 5.35 \quad (5).$$

In the same preferred embodiment, the golf ball may satisfy formula (6) below:

$$5.70 \leq (MCS+HCS)/LCS \times BC \leq 6.10 \quad (6).$$

In yet another preferred embodiment, the coefficient of restitution for the ball satisfies formula (3) below:

$$5.90 \leq (MBS+HBS)/LBS \times BC \leq 6.50 \quad (3).$$

In still another preferred embodiment, the coefficient of restitution for the intermediate layer-encased sphere satisfies formula (4) below:

$$5.85 \leq (MMS+HMS)/LMS \times BC \leq 6.50 \quad (4).$$

In a further preferred embodiment, the core center and surface have a hardness difference therebetween on the Shore C hardness scale of at least 20.

In a still further preferred embodiment, the golf ball satisfies the surface hardness relationship below:

Shore D hardness at cover surface>Shore D hardness at intermediate layer surface>Shore D hardness at core center.

In a yet further preferred embodiment, the golf ball has a construction of at least four layers that includes an envelope layer between the core and the intermediate layer. In this preferred embodiment, the ball may satisfy the following relationship among surface hardness values:

Shore D hardness at cover surface>Shore D hardness at intermediate layer surface>Shore D hardness at envelope layer surface>Shore D hardness at core center.

In another preferred embodiment of the golf ball of the invention, MBS≥0.780 and MMS≥0.775.

Advantageous Effects of the Invention

The golf ball of the invention has an excellent flight performance when hit by golfers whose head speeds are not that high and also has a good feel that is both soft and solid, making it highly suitable for use by amateur golfers.

BRIEF DESCRIPTION OF THE DIAGRAMS

FIG. 1 is a schematic cross-sectional view of a golf ball having a four-layer construction according to one embodiment of the invention.

DESCRIPTION OF THE PREFERRED EMBODIMENTS

The objects, features and advantages of the invention will become more apparent from the following detailed description taken in conjunction with the appended diagram.

The golf ball of the invention has a core, an intermediate layer and a cover. In this invention, the cover refers to the member positioned as the outermost layer in the ball construction and is typically formed by molding, such as injection molding. Numerous dimples are typically formed on the outer surface of the cover at the same time that the cover material is injection molded.

The core has a diameter of preferably at least 34.0 mm, more preferably at least 34.5 mm, and even more preferably at least 35.0 mm. The upper limit is preferably not more than 37.0 mm, more preferably not more than 36.5 mm, and even more preferably not more than 36.0 mm. When the core diameter is too small, the spin rate on shots with a driver (W #1) may become high and it may not be possible to achieve the desired distance. On the other hand, when the core diameter is too large, the durability to repeated impact may worsen or the feel at impact may worsen.

The core has a compressive deformation (mm) when compressed under a final load of 1,275 N (130 kgf) from an initial load of 98 N (10 kgf) which, although not particularly limited, is preferably at least 3.0 mm, more preferably at least 3.5 mm, and even more preferably at least 4.0 mm. The upper limit is preferably not more than 7.0 mm, more preferably not more than 6.0 mm, and even more preferably not more than 5.0 mm. When the compressive deformation of the core is too small, i.e., when the core is too hard, the spin rate of the ball may rise excessively and a good distance may not be achieved, or the feel at impact may be too hard. On the other hand, when the compressive deformation of the core is too large, i.e., when the core is too soft, the ball rebound may become too low and a good distance may not be achieved, the feel at impact may be too soft, or the durability to cracking on repeated impact may worsen.

The core is formed of a single layer or a plurality of layers of rubber material. A rubber composition can be prepared as this core-forming rubber material by using a base rubber as the chief component and including, together with this, other ingredients such as a co-crosslinking agent, an organic peroxide, an inert filler and an organosulfur compound. It is preferable to use polybutadiene as the base rubber.

Commercial products may be used as the polybutadiene. Illustrative examples include BR01, BR51 and BR730 (all products of JSR Corporation). The proportion of polybutadiene within the base rubber is preferably at least 60 wt %, and more preferably at least 80 wt %. Rubber ingredients other than the above polybutadienes may be included in the base rubber, provided that doing so does not detract from the advantageous effects of the invention. Examples of rubber ingredients other than the above polybutadienes include other polybutadienes and also other diene rubbers, such as styrene-butadiene rubbers, natural rubbers, isoprene rubbers and ethylene-propylene-diene rubbers.

Examples of co-crosslinking agents include unsaturated carboxylic acids and metal salts of unsaturated carboxylic acids. Specific examples of unsaturated carboxylic acids include acrylic acid, methacrylic acid, maleic acid and fumaric acid. The use of acrylic acid or methacrylic acid is especially preferred. Metal salts of unsaturated carboxylic acids are exemplified by, without particular limitation, the above unsaturated carboxylic acids that have been neutralized with desired metal ions. Specific examples include the zinc salts and magnesium salts of methacrylic acid and acrylic acid. The use of zinc acrylate is especially preferred.

The unsaturated carboxylic acid and/or metal salt thereof is included in an amount, per 100 parts by weight of the base rubber, which is typically at least 5 parts by weight, preferably at least 9 parts by weight, and more preferably at least 13 parts by weight. The amount included is typically not more than 60 parts by weight, preferably not more than 50 parts by weight, and more preferably not more than 40 parts by weight. Too much may make the core too hard, giving the ball an unpleasant feel at impact, whereas too little may lower the rebound.

Commercial products may be used as the organic peroxide. Examples of such products that may be suitably used include Percumyl D, Perhexa C-40 and Perhexa 3M (all from NOF Corporation), and Luperco 231XL (from AtoChem Co.). One of these may be used alone, or two or more may be used together. The amount of organic peroxide included per 100 parts by weight of the base rubber is preferably at least 0.1 part by weight, more preferably at least 0.3 part by weight, even more preferably at least 0.5 part by weight, and most preferably at least 0.6 part by weight. The upper limit is preferably not more than 5 parts by weight, more preferably not more than 4 parts by weight, even more preferably not more than 3 parts by weight, and most preferably not more than 2.5 parts by weight. When too much or too little is included, it may not be possible to obtain a ball having a good feel, durability and rebound.

Another compounding ingredient typically included with the base rubber is an inert filler, preferred examples of which include zinc oxide, barium sulfate and calcium carbonate. One of these may be used alone, or two or more may be used together. The amount of inert filler included per 100 parts by weight of the base rubber is preferably at least 1 part by weight, and more preferably at least 5 parts by weight. The upper limit is preferably not more than 50 parts by weight, more preferably not more than 40 parts by weight, and even more preferably not more than 35 parts by weight. Too much or too little inert filler may make it impossible to obtain a proper weight and a suitable rebound.

In addition, an antioxidant may be optionally included. Illustrative examples of suitable commercial antioxidants include Nocrac NS-6 and Nocrac NS-30 (both available from Ouchi Shinko Chemical Industry Co., Ltd.), and Yoshinox 425 (available from Yoshitomi Pharmaceutical Industries, Ltd.). One of these may be used alone, or two or more may be used together.

The amount of antioxidant included per 100 parts by weight of the base rubber is set to 0 part by weight or more, preferably at least 0.05 part by weight, and more preferably at least 0.1 part by weight. The upper limit is set to preferably not more than 3 parts by weight, more preferably not more than 2 parts by weight, even more preferably not more than 1 part by weight, and most preferably not more than 0.5 part by weight. Too much or too little antioxidant may make it impossible to achieve a suitable ball rebound and durability.

An organosulfur compound may be included in the core in order to impart a good resilience. The organosulfur compound is not particularly limited, provided it can enhance the rebound of the golf ball. Exemplary organosulfur compounds include thiophenols, thionaphthols, halogenated thiophenols, and metal salts of these. Specific examples include pentachlorothiophenol, pentafluorothiophenol, pentabromothiophenol, p-chlorothiophenol, the zinc salt of pentachlorothiophenol, the zinc salt of pentafluorothiophenol, the zinc salt of pentabromothiophenol, the zinc salt of p-chlorothiophenol, and any of the following having 2 to 4 sulfur atoms: diphenylpolysulfides, dibenzylpolysulfides, dibenzoylpolysulfides, dibenzothiazoylpolysulfides and dithiobenzoylpolysulfides. The use of the zinc salt of pentachlorothiophenol is especially preferred.

The amount of organosulfur compound included per 100 parts by weight of the base rubber is 0 part by weight or more, and it is recommended that the amount be preferably at least 0.1 part by weight, and even more preferably at least 0.2 part by weight, and that the upper limit be preferably not more than 5 parts by weight, more preferably not more than 3 parts by weight, and even more preferably not more than 2 parts by weight. Including too much organosulfur compound may make a greater rebound-improving effect (particularly on shots with a W #1) unlikely to be obtained, may make the core too soft or may worsen the feel of the ball at impact. On the other hand, including too little may make a rebound-improving effect unlikely.

Decomposition of the organic peroxide within the core formulation can be promoted by the direct addition of water (or a water-containing material) to the core material. The decomposition efficiency of the organic peroxide within the core-forming rubber composition is known to change with temperature; starting at a given temperature, the decomposition efficiency rises with increasing temperature. If the temperature is too high, the amount of decomposed radicals rises excessively, leading to recombination between radicals and, ultimately, deactivation. As a result, fewer radicals act effectively in crosslinking. Here, when a heat of decomposition is generated by decomposition of the organic peroxide at the time of core vulcanization, the vicinity of the core surface remains at substantially the same temperature as the temperature of the vulcanization mold, but the temperature near the core center, due to the build-up of heat of decomposition by the organic peroxide which has decomposed from the outside, becomes considerably higher than the mold temperature. In cases where water (or a water-containing material) is added directly to the core, because the water acts to promote decomposition of the organic peroxide, radical reactions like those described above can be made to differ at the core center and core surface. That is, decomposition of the organic peroxide is further promoted near the center of the core, bringing about greater radical deactivation, which leads to a further decrease in the amount of active radicals. As a result, it is possible to obtain a core in which the crosslink densities at the core center and the core surface differ markedly. It is also possible to obtain a core having different dynamic viscoelastic properties in the center portion thereof.

The water included in the core material is not particularly limited, and may be distilled water or tap water. The use of distilled water that is free of impurities is especially preferred. The amount of water included per 100 parts by weight of the base rubber is preferably at least 0.1 part by weight, and more preferably at least 0.3 part by weight. The upper limit is preferably not more than 5 parts by weight, and more preferably not more than 4 parts by weight.

The core can be produced by vulcanizing and curing the rubber composition containing the above ingredients. For example, the core can be produced by using a Banbury mixer, roll mill or other mixing apparatus to intensively mix the rubber composition, subsequently compression molding or injection molding the mixture in a core mold, and curing the resulting molded body by suitably heating it under conditions sufficient to allow the organic peroxide or co-crosslinking agent to act, such as at a temperature of between 100 and 200° C., preferably between 140 and 180° C., for 10 to 40 minutes.

The core may consist of a single layer alone, or may be formed as a two-layer core consisting of an inner core layer and an outer core layer. When the core is formed as a two-layer core consisting of an inner core layer and an outer core layer, the inner core layer and outer core layer materials may each be composed primarily of the above-described rubber material. The rubber material making up the outer core layer encasing the inner core layer may be the same as or different from the inner core layer material. The details here are the same as those given above for the ingredients of the core-forming rubber material.

Next, the core hardness profile is described.

The core center has a hardness (Cc) which, expressed on the Shore C hardness scale, is preferably at least 40, more preferably at least 45, and even more preferably at least 48. The upper limit is preferably not more than 62, more preferably not more than 60, and even more preferably not more than 57. When this value is too large, the feel at impact may become hard, or the spin rate on full shots may rise, as a result of which the intended distance may not be achieved. On the other hand, when this value is too small, the rebound may become low, resulting in a poor distance, or the durability to cracking on repeated impact may worsen. The Shore C hardness is the hardness value measured with a Shore C durometer in general accordance with ASTM D2240.

The core center hardness (Cc), expressed on the Shore D hardness scale, is preferably at least 24, more preferably at least 26, and even more preferably at least 28. The upper limit is preferably not more than 40, more preferably not more than 37, and even more preferably not more than 34.

The core surface has a hardness (Cs) which, expressed on the Shore C hardness scale, is preferably at least 70, more preferably at least 72, and even more preferably at least 74. The upper limit is preferably not more than 85, more preferably not more than 82, and even more preferably not more than 80. A value outside of this range may lead to undesirable results similar to those described above for the core center hardness (Cc).

The core surface hardness (Cs) expressed on the Shore D hardness scale is preferably at least 40, more preferably at least 43, and even more preferably at least 46. The upper limit is preferably not more than 56, more preferably not more than 54, and even more preferably not more than 52.

The difference between the core surface hardness (Cs) and the core center hardness (Cc), expressed on the Shore C hardness scale, is preferably at least 20, more preferably at least 22, and even more preferably at least 24. The upper limit is preferably not more than 32, and more preferably not more than 30. When this value is too small, the ball spin rate-lowering effect on shots with a driver may be inadequate, resulting in a poor distance. When this value is too large, the initial velocity of the ball when struck may decrease, resulting in a poor distance, or the durability to cracking on repeated impact may worsen.

Next, the cover is described.

The cover has a material hardness on the Shore D scale which, although not particularly limited, is preferably at least 55, more preferably at least 59, and even more preferably at least 61. The upper limit is preferably not more than 70, more preferably not more than 68, and even more preferably not more than 65. The surface hardness of the cover (also referred to herein as the "ball surface hardness"), expressed on the Shore D hardness scale, is preferably at least 61, more preferably at least 65, and even more preferably at least 67. The upper limit is preferably not more than 76, more preferably not more than 74, and even more preferably not more than 71. When the material hardness of the cover and the ball surface hardness are too much lower than the above respective ranges, the spin rate of the ball on shots with a driver (W #1) may rise and the ball initial velocity may decrease, as a result of which a good distance may not be achieved. On the other hand, when the material hardness of the cover and the ball surface hardness are too high, the durability to cracking on repeated impact may worsen.

The cover has a thickness of preferably at least 0.5 mm, more preferably at least 0.8 mm, and even more preferably at least 1.1 mm. The upper limit in the cover thickness is preferably not more than 1.5 mm, more preferably not more than 1.4 mm, and even more preferably not more than 1.3 mm. When the cover is too thin, the durability to cracking on repeated impact may worsen. When the cover is too thick, the spin rate of the ball on shots with a driver (W #1) may rise excessively and a good distance may not be achieved, or the feel at impact in the short game and on shots with a putter may become too hard.

Various types of thermoplastic resins, particularly ionomer resins, that are employed as cover stock in golf balls may be suitably used as the cover material. Commercial products may be used as the ionomer resin. Alternatively, the cover-forming resin material that is used may be one obtained by blending, of commercially available ionomer resins, a high-acid ionomer resin having an acid content of at least 18 wt % into an ordinary ionomer resin. The high rebound and the spin rate-lowering effect obtained with such a blend make it possible to achieve a good distance on shots with a driver (W #1). The amount of such a high-acid ionomer resin included in 100 wt % of the resin material is preferably at least 10 wt %, more preferably at least 30 wt %, and even more preferably at least 60 wt %. The upper limit is generally up to 100 wt %, preferably up to 90 wt %, and more preferably up to 80 wt %. When the content of this high-acid ionomer resin is too low, the spin rate on shots with a driver (W #1) may rise, resulting in a poor distance. On the other hand, when the content of the high-acid ionomer resin is too high, the durability to cracking on repeated impact may worsen.

The golf ball of the present invention has an intermediate layer between the above core and the above cover. In this invention, aside from a golf ball composed of three layers (these being a core, an intermediate layer and a cover), the use of a golf ball composed of four layers (a core, an envelope layer, an intermediate layer and a cover) is also suitable. Such golf balls are exemplified by the golf ball G shown in FIG. 1, which has a core 1, an envelope layer 2 encasing the core 1, an intermediate layer 3 encasing the envelope layer 2, and a cover 4 encasing the intermediate layer 3. This cover 4 is positioned as, aside from a coating layer, the outermost layer in the layer structure of the golf ball. The intermediate layer and the envelope layer may each be either a single layer or may be formed of two or more layers. Numerous dimples D are typically formed on the surface of the cover (outermost layer) 4 in order to enhance the aerodynamic properties. In addition, a coating layer 5 is formed on the surface of the cover 4.

The intermediate layer formed between the core and the cover in this inventions is described.

The intermediate layer has a material hardness on the Shore D hardness scale which, although not particularly limited, is preferably at least 40, more preferably at least 45, and even more preferably at least 50. The upper limit is preferably not more than 62, more preferably not more than 60, and even more preferably not more than 58. The surface hardness of the sphere obtained by encasing the core (or, if there is an envelope layer (see below), by encasing the envelope layer-encased sphere) with the intermediate layer (intermediate layer-encased sphere), expressed on the Shore D scale, is preferably at least 46, more preferably at least 51, and even more preferably at least 56. The upper limit is preferably not more than 68, more preferably not more than 66, and even more preferably not more than 64. When the material and surface hardnesses of the intermediate layer are lower than the above respective ranges, the spin rate of the ball on full shots may rise excessively, resulting in a poor distance, or the ball may cease to have a solid feel at impact. On the other hand, when the material and surface hardnesses are too high, the durability to cracking on repeated impact may worsen or the ball may cease to have a soft feel at impact.

The intermediate layer has a thickness of preferably at least 0.7 mm, more preferably at least 0.9 mm, and even more preferably at least 1.1 mm. The upper limit in the intermediate layer thickness is preferably not more than 1.5 mm, more preferably not more than 1.4 mm, and even more preferably not more than 1.35 mm. When the intermediate layer is too thin, the durability to cracking on repeated impact may worsen or the feel at impact may worsen. When the intermediate layer is too thick, the spin rate of the ball on full shots may rise and a good distance may not be obtained.

The intermediate layer-forming material is not particularly limited and may be a known resin. Examples of preferred materials include resin compositions containing as the essential ingredients:

100 parts by weight of a resin component composed of, in admixture, (A) a base resin of (a-1) an olefin-unsaturated carboxylic acid random copolymer and/or a metal ion neutralization product of an olefin-unsaturated carboxylic acid random copolymer mixed with (a-2) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in a weight ratio between 100:0 and 0:100, and (B) a non-ionomeric thermoplastic elastomer in a weight ratio between 100:0 and 50:50;

(C) from 5 to 120 parts by weight of a fatty acid and/or fatty acid derivative having a molecular weight of from 228 to 1,500; and (D) from 0.1 to 17 parts by weight of a basic inorganic metal compound capable of neutralizing un-neutralized acid groups in components A and C.

Components A to D in the intermediate layer-forming resin material described in, for example, JP-A 2010-253268 may be advantageously used as above components A to D.

A non-ionomeric thermoplastic elastomer may be included in the intermediate layer material. The amount of non-ionomeric thermoplastic elastomer included is preferably from 0 to 50 parts by weight per 100 parts by weight of the total amount of the base resin.

Exemplary non-ionomeric thermoplastic elastomers include polyolefin elastomers (including polyolefin and metallocene polyolefins), polystyrene elastomers, diene polymers, polyacrylate polymers, polyamide elastomers, polyurethane elastomers, polyester elastomers and polyacetals.

Depending on the intended use, optional additives may be suitably included in the intermediate layer material. For example, pigments, dispersants, antioxidants, ultraviolet absorbers and light stabilizers may be added. When these additives are included, the amount added per 100 parts by weight of the overall base resin is preferably at least 0.1 part by weight, and more preferably at least 0.5 part by weight. The upper limit is preferably not more than 10 parts by weight, and more preferably not more than 4 parts by weight.

In addition, an envelope layer may be formed between the above core and the above intermediate layer. The envelope layer in such a case is described below.

The envelope layer has a material hardness on the Shore D hardness scale which, although not particularly limited, is preferably at least 20, more preferably at least 23, and even more preferably at least 27. The upper limit is preferably not more than 45, more preferably not more than 42, and even more preferably not more than 40. The surface hardness of the sphere obtained by encasing the core with the envelope layer (envelope layer-encased sphere), expressed on the Shore D hardness scale, is preferably at least 28, more preferably at least 31, and even more preferably at least 35. The upper limit is preferably not more than 53, more preferably not more than 50, and even more preferably not more than 48. When the material and surface hardnesses of the envelope layer are lower than the above respective ranges, the spin rate of the ball on full shots may rise excessively, resulting in a poor distance, or the durability of the ball to repeated impact may worsen. On the other hand, when the material and surface hardnesses are too high, the durability to cracking on repeated impact may worsen or the spin rate on full shots may rise, as a result of which, particularly on low head speed shots, a good distance may not be achieved, and the feel at impact may worsen.

The envelope layer has a thickness of preferably at least 0.7 mm, more preferably at least 0.9 mm, and even more preferably at least 1.1 mm. The upper limit in the envelope layer thickness is preferably not more than 1.5 mm, more preferably not more than 1.4 mm, and even more preferably not more than 1.3 mm. When this envelope layer is too thin, the durability to cracking on repeated impact may worsen or the feel at impact may worsen. When the envelope layer is too thick, the spin rate of the ball on full shots may rise and a good distance may not be achieved.

The envelope layer material is not particularly limited, although various types of thermoplastic resin materials may be suitably employed for this purpose. For example, use can be made of ionomer resins, urethane, amide, ester, olefin or styrene-type thermoplastic elastomers, and mixtures thereof. From the standpoint of obtaining a good rebound in the desired hardness range, the use of a thermoplastic polyether ester elastomer is especially suitable.

The manufacture of multi-piece solid golf balls in which the above-described core, optional envelope layer, intermediate layer and cover (outermost layer) are formed as successive layers may be carried out in the usual manner such as by a known injection molding process. For example, a multi-piece golf ball can be obtained by successively injection-molding the envelope layer material and the intermediate layer material over the core so as to obtain an intermediate layer-encased sphere, and then injection-molding the cover material over the intermediate layer-encased sphere. Alternatively, the encasing layers may each be formed by enclosing the sphere to be encased within two half-cups that have been pre-molded into hemispherical shapes and then molding under applied heat and pressure.

The golf ball of the invention has a compressive deformation (BC) when compressed under a final load of 130 kgf from an initial load of 10 kgf which is preferably at least 2.80 mm, more preferably at least 2.90 mm, and even more preferably at least 2.95 mm. The upper limit is preferably not more than 3.65 mm, more preferably not more than 3.55 mm, and even more preferably not more than 3.45 mm. When this value is too small, the spin rate of the ball may end up rising, as a result of which a good distance may not be achieved, and the feel at impact may be too hard. On the other hand, when this value is too large, the ball rebound may become too low, as a result of which a good distance may not be achieved, the feel at impact may be too soft, or the durability to cracking under repeated impact may worsen.

In this invention, letting LBS, MBS and HBS be the respective coefficients of restitution (COR) for the ball at incident velocities of 35 m/s, 45 m/s and 55 m/s, LMS, MMS and HMS be the respective coefficients of restitution (COR) for the sphere obtained by encasing the core with the intermediate layer (intermediate layer-encased sphere) at incident velocities of 35 m/s, 45 m/s and 55 m/s and BC be the compressive deformation (mm) of the ball when compressed under a final load of 1,275 N (130 kgf) from an initial load of 98 N (10 kgf), the ball is characterized by satisfying formulas (1) and (2) below:

$$5.10 \leq (LBS+MBS) \times BC \leq 5.50 \quad (1)$$

$$5.10 \leq (LMS+MMS) \times BC \leq 5.50 \quad (2),$$

with the proviso that LBS≥0.820 and LMS≥0.820.

That is, in this invention, by optimizing the velocity ratio COR of the manufactured ball at an incident velocity of 35 m/s (LBS) and the velocity ratio COR of the intermediate layer-encased sphere at an incident velocity of 35 m/s (LMS), the distance performance of the ball when hit by golfers having head speeds (HS) of from about 30 m/s to about 45 m/s is increased. By also designing the golf ball in such a way that the relationship with the hardness of the manufactured ball (BC) satisfies the above formulas, the desired flight performance and a good feel at impact that has a solid feel are both achieved.

The value in above formula (1) is at least 5.10, and preferably at least 5.15, but is not more than 5.50.

The value in above formula (2) is at least 5.10, but is not more than 5.50.

The LBS value, which is the coefficient of restitution (COR) for the ball at an incident velocity of 35 m/s, is at least 0.820, and preferably at least 0.825.

The LMS value, which is the coefficient of restitution (COR) for the intermediate layer-encased sphere at an incident velocity of 35 m/s, is at least 0.820, and preferably at least 0.823.

The MBS value, which is the coefficient of restitution (COR) for the ball at an incident velocity of 45 m/s, is preferably at least 0.777, and more preferably at least 0.780.

The MMS value, which is the coefficient of restitution (COR) for the intermediate layer-encased sphere at an incident velocity of 45 m/s, is preferably at least 0.772, and more preferably at least 0.775.

It is desirable for the above coefficients of restitution for the golf ball to satisfy formula (3) below:

$$5.90 \leq (MBS+HBS)/LBS \times BC \leq 6.50 \quad (3).$$

The value in this formula is preferably 6.30 or less.

In addition, it is desirable for the above coefficients of restitution for the golf ball to satisfy formula (4) below:

$$5.85 \leq (MMS+HMS)/LMS \times BC \leq 6.50 \quad (4).$$

The value in this formula is preferably 6.30 or less.

The HBS value, which is the coefficient of restitution (COR) for the ball at an incident velocity of 55 m/s, is preferably at least 0.730, and more preferably at least 0.735.

The HMS value, which is the coefficient of restitution (COR) for the intermediate layer-encased sphere at an incident velocity of 55 m/s, is preferably at least 0.720, and more preferably at least 0.725.

It is desirable for the above coefficients of restitution for the core to satisfy formula (5) below:

$$5.00 \leq (MCS+LCS) \times BC \leq 5.35 \quad (5).$$

The value in this formula is preferably 5.30 or less.

In addition, it is desirable for the above coefficients of restitution for the core to satisfy formula (6) below:

$$5.70 \leq (MCS+HCS)/LCS \times BC \leq 6.10 \quad (6).$$

The LCS value, which is the coefficient of restitution (COR) for the core at an incident velocity of 35 m/s, is preferably not more than 0.820, and more preferably not more than 0.815.

The MCS value, which is the coefficient of restitution (COR) for the core at an incident velocity of 45 m/s, is preferably not more than 0.760, and more preferably not more than 0.757.

The HCS value, which is the coefficient of restitution (COR) for the core at an incident velocity of 55 m/s, is preferably not more than 0.710, and more preferably not more than 0.700.

Measurement of the coefficients of restitution (COR) for the various above spheres—i.e., the core, the intermediate layer-encased sphere and the ball—can be carried out using an ADC Ball COR Durability Tester produced by Automated Design Corporation (U.S.). This tester fires the respective spheres pneumatically at initial velocities of 35 m/s, 45 m/s and 55 m/s, causing them to strike a metal plate situated at a given distance. The value obtained by dividing the return velocity by the initial velocity can be treated as the coefficient of restitution for the particular sphere at that initial velocity.

Surface Hardness Relationships Among Layers

The hardness relationships among the layers preferably satisfy formula (I) below:

(I) Shore D hardness at cover surface>Shore D hardness at intermediate layer surface>Shore D hardness at core center.

When the golf ball includes an envelope layer, the hardness relationships among the layers preferably satisfy formula (II) below:

(II) Shore D hardness at cover surface>Shore D hardness at intermediate layer surface>Shore D hardness at envelope layer surface>Shore D hardness at core center.

Here, the hardness at the cover surface refers to the surface hardness of the ball. The hardness at the intermediate layer surface refers to the surface hardness of the intermediate layer-encased sphere, and the hardness at the envelope layer surface refers to the surface hardness of the envelope layer-encased sphere.

When the above hardness relationships are not satisfied, a good flight performance and a feel at impact that is both soft and solid may not be obtained.

As indicated in the above formulas, the cover surface hardness is larger than the intermediate layer surface hardness. The difference therebetween, i.e., the "cover surface hardness−intermediate layer surface hardness" value, expressed on the Shore D hardness scale, is preferably from 1 to 14, more preferably from 3 to 10, and even more preferably from 5 to 8. When this value is small, the spin rate of the ball on full shots may end up rising, as a result of which a good distance may not be achieved. On the other hand, when this value is large, the feel at impact may worsen or the durability to cracking on repeated impact may worsen.

As indicated in above formula (II), the intermediate layer surface hardness is larger than the envelope layer surface hardness. The difference therebetween, i.e., the "intermediate layer surface hardness−envelope layer surface hardness" value, expressed on the Shore D hardness scale, is preferably from 10 to 28, more preferably from 13 to 26, and even more preferably from 15 to 24. When this value is small, the spin rate of the ball on full shots may rise, as a result of which a good distance may not be achieved. On the other hand, when this value is large, the feel at impact may worsen or the durability to cracking on repeated impact may worsen.

As indicated in above formula (II), the envelope layer surface hardness is larger than the core center hardness. The difference therebetween, i.e., the "envelope layer surface hardness−core center hardness" value, expressed on the Shore D hardness scale, is preferably from 3 to 23, more preferably from 5 to 20, and even more preferably from 10 to 18. Also, the "envelope layer surface hardness−core surface hardness" value, expressed on the Shore D hardness scale, is preferably from −20 to 8, more preferably from −15 to 3, and even more preferably from −10 to 0. When these values are small, the spin rate of the ball on full shots may rise, as a result of which a good distance may not be achieved. On the other hand, when these values are large, the feel at impact may worsen or the durability to cracking on repeated impact may worsen.

Also, the "core surface hardness−ball surface hardness" value, expressed on the Shore D hardness scale, is preferably from −30 to −10, more preferably from −25 to −12, and even more preferably from −21 to −15. When this value is small, the solid feel of the ball at impact may be lost or the durability to cracking on repeated impact may worsen. On the other hand, when this value is large, ball striking conditions may emerge under which the spin rate of the ball rises and a good distance is not achieved.

Numerous dimples may be formed on the outside surface of the cover serving as the outermost layer. The number of dimples arranged on the cover surface, although not particularly limited, is preferably at least 250, more preferably at least 300, and even more preferably at least 320. The upper limit is preferably not more than 380, more preferably not more than 350, and even more preferably not more than 340. When the number of dimples is higher than this range, the ball trajectory may become lower and the distance traveled by the ball may decrease. On the other hand, when the number of dimples is lower that this range, the ball trajectory may become higher and a good distance may not be achieved.

The dimple shapes used may be of one type or may be a combination of two or more types suitably selected from among, for example, circular shapes, various polygonal shapes, dewdrop shapes and oval shapes. When circular dimples are used, the dimple diameter may be set to at least about 2.5 mm and up to about 6.5 mm, and the dimple depth may be set to at least 0.08 mm and up to 0.30 mm.

In order for the aerodynamic properties to be fully manifested, it is desirable for the dimple coverage ratio on the spherical surface of the golf ball, i.e., the dimple surface coverage SR, which is the sum of the individual dimple surface areas, each defined by the flat plane circumscribed by the edge of a dimple, as a percentage of the spherical surface area of the ball were the ball to have no dimples thereon, to be set to at least 70% and not more than 90%. Also, to optimize the ball trajectory, it is desirable for the value $V_0$, defined as the spatial volume of the individual dimples below the flat plane circumscribed by the dimple edge, divided by the volume of the cylinder whose base is the flat plane and whose height is the maximum depth of the dimple from the base, to be set to at least 0.35 and not more than 0.80. Moreover, it is preferable for the ratio VR of the sum of the volumes of the individual dimples, each formed below the flat plane circumscribed by the edge of a dimple, with respect to the volume of the ball sphere were the ball surface to have no dimples thereon, to be set to at least 0.6% and not more than 1.2%. Outside of the above ranges in these respective values, the resulting trajectory may not enable a good distance to be achieved and so the ball may fail to travel a fully satisfactory distance.

To ensure a good ball appearance, it is preferable to apply a clear coating to the cover surface. The coating composition used in clear coating is preferably one which uses two types of polyester polyol as the base resin and uses a polyisocyanate as the curing agent. In this case, various organic solvents can be admixed depending on the intended coating conditions.

The coating layer obtained by clear coating has a hardness which, on the Shore C hardness scale, is preferably from 40 to 80, more preferably from 47 to 72, and even more preferably from 55 to 65. When the coating layer is too soft, mud may tend to stick to the surface of the ball when used for golfing. On the other hand, when the coating layer is too hard, it may tend to peel off when the ball is struck.

The coating layer has a thickness of typically from 9 to 22 μm, preferably from 11 to 20 μm, and more preferably from 13 to 18 μm. When the coating layer is thinner than this range, the cover protecting effect may be inadequate. On the other hand, when the coating layer is thicker than this range, the dimple shapes may no longer be sharp, as a result of which a good distance may not be achieved.

The golf ball of the invention can be made to conform to the Rules of Golf for competitive play. The inventive ball may be formed to a diameter which is such that the ball does not pass through a ring having an inner diameter of 42.672 mm and is not more than 42.80 mm, and to a weight which is preferably between 45.0 and 45.93 g.

EXAMPLES

The following Examples and Comparative Examples are provided to illustrate the invention, and are not intended to limit the scope thereof.

Examples 1 and 2, Comparative Examples 1 to 4

Formation of Core

Solid cores were produced by preparing rubber compositions for the respective Examples and Comparative Examples shown in Table 1, and then molding/vulcanizing the compositions under vulcanization conditions of 155° C. and 15 minutes.

TABLE 1

| Core formulation (pbw) | A | B | C | D | E |
|---|---|---|---|---|---|
| Polybutadiene A | 80 | 80 | 80 | 80 | 70 |
| Polybutadiene B | 20 | 20 | 20 | 20 | 30 |
| Zinc acrylate | 26.9 | 28.2 | 29.6 | 20.0 | 35.8 |
| Organic peroxide (1) | 1 | 1 | 1 | 0.6 | 1 |
| Organic peroxide (2) | | | | 0.6 | |
| Water | 1.0 | 1.0 | 1.0 | | 0.4 |
| Antioxidant | 0.1 | 0.1 | 0.1 | 0.1 | 0.1 |
| Barium sulfate | 27.9 | 27.4 | 26.8 | 17.9 | |
| Zinc oxide | 4.0 | 4.0 | 4.0 | 4.0 | 15.3 |
| Zinc salt of pentachlorothiophenol | 0.3 | 0.3 | 0.3 | 0.2 | 0.2 |

Details on the ingredients mentioned in Table 1 are given below.

Polybutadiene A: Available under the trade name "BR 01" from JSR Corporation

Polybutadiene B: Available under the trade name "BR 51" from JSR Corporation

Zinc acrylate: Available as "ZN-DA85S" from Nippon Shokubai Co., Ltd.

Organic Peroxide (1): Dicumyl peroxide, available under the trade name "Percumyl D" from NOF Corporation Organic Peroxide (2): A mixture of 1,1-di(t-butylperoxy) cyclohexane and silica, available under the trade name "Perhexa C-40" from NOF Corporation Water: Pure water (from Seiki Chemical Industrial Co., Ltd.)

Antioxidant: 2,2'-Methylenebis(4-methyl-6-butylphenol), available under the trade name "Nocrac NS-6" from Ouchi Shinko Chemical Industry Co., Ltd.

Barium sulfate: Baryte powder available as "Barico #100" from Hakusui Tech

Zinc oxide: Available as "Zinc Oxide Grade 3" from Sakai Chemical Co., Ltd.

Zinc salt of pentachlorothiophenol: Available from Wako Pure Chemical Industries, Ltd.

Formation of Envelope Layer, Intermediate Layer and Cover

Next, in Examples 1 and 2 and Comparative Example 1, an envelope layer was formed by injection-molding the envelope layer material formulated as shown in Table 2 over the core, following which an intermediate layer was formed by injection-molding the intermediate layer material formulated as shown in the same table, thereby giving a sphere encased by an envelope layer and an intermediate layer. In Comparative Examples 2 and 3, an intermediate layer was formed by injection-molding the intermediate layer material formulated as shown in Table 2 over the core, thereby giving an intermediate layer-encased sphere.

Next, in Examples 1 and 2 and Comparative Examples 1 to 3, a cover (outermost layer) was formed by injection-molding the cover material formulated as shown in Table 2 over the intermediate layer-encased sphere obtained as described above. A plurality of given dimples common to all the Examples and Comparative Examples were formed at this time on the surface of the cover.

Comparative Example 4 used the three-piece solid golf ball having a core, an intermediate layer and a cover that is available as "XXIO SUPER SOFT X, 2018 model" from Sumitomo Rubber Industries, Ltd.

TABLE 2

| Resin material (pbw) | (1) | (2) | (3) | (4) | (5) | (6) | (7) | (8) | (9) |
|---|---|---|---|---|---|---|---|---|---|
| Hytrel 4001 | 100 | | | | | | | | 11 |
| Hytrel 3046 | | 100 | | | | | | | |
| HPF 2000 | | | 100 | | | | | | |
| HPF 1000 | | | | 56 | | | | | |
| Himilan 1605 | | | | 44 | | | 50 | 50 | |
| Himilan 1557 | | | | | | | | 15 | |
| Himilan 1706 | | | | | | | | 35 | |
| AM7318 | | | | | | 75 | | | |
| AM7327 | | | | | | 25 | | | |
| AM7329 | | | | | | | 15 | | |
| Surlyn 9320 | | | | | 70 | | 35 | | |
| AN4221C | | | | | 30 | | | | |
| T-8290 | | | | | | | | | 75 |
| T-8283 | | | | | | | | | 25 |
| Polyethylene wax | | | | | | | | | 1.2 |
| Isocyanate compound | | | | | | | | | 7.5 |
| Magnesium stearate | | | | | 60 | | | | |
| Magnesium oxide | | | | | 1.12 | | | | |
| Titanium oxide | | | | | | 4 | 4 | | 3.9 |

Trade names of the chief materials mentioned in Table 2 are given below.

Hytrel: Polyester elastomers available from DuPont-Toray Co., Ltd.

HPF 1000: DuPont™ HPF 1000

HPF 2000: DuPont™ HPF 2000

Himilan, AM7318, AM7327, AM7329: Ionomers available from DuPont-Mitsui Polychemicals Co., Ltd.

Surlyn 9320: An ionomer available from E.I. DuPont de Nemours & Co.

AN 4221C: Available under the trade name "Nucrel" from DuPont-Mitsui Polychemicals Co., Ltd.

T-8920, T-8283: Thermoplastic polyurethanes available under the trade name "Pandex" from DIC Covestro Polymer, Ltd.

Polyethylene wax: Available under the trade name "Sanwax 161P" from Sanyo Chemical Industries, Ltd.

Isocyanate compound: 4,4'-Diphenylmethane diisocyanate

Magnesium stearate: Available as "Magnesium Stearate G" from NOF Corporation

Magnesium oxide: Available as "Kyowamag MF-150" from Kyowa Chemical Industry Co., Ltd.

Titanium oxide: Available from Sakai Chemical Industry Co., Ltd.

Various properties of the resulting golf balls, including the core center and surface hardnesses, the material hardnesses of the respective layers (envelope layer, intermediate layer and cover), the surface hardnesses of the respective layer-encased spheres, and the compressive deformations of the core and the ball were evaluated by the following methods. The results are presented in Table 3.

Diameters of Core, Envelope Layer-Encased Sphere and Intermediate Layer-Encased Sphere The diameters at five random places on the surface were measured at a temperature of 23.9±1° C. and, using the average of these measurements as the measured value for a single core, envelope layer-encased sphere or intermediate layer-encased sphere, the average diameter for ten measured spheres was determined.

Diameter of Ball

The diameters at 15 random dimple-free areas on the surface of a ball were measured at a temperature of 23.9±1° C. and, using the average of these measurements as the measured value for a single ball, the average diameter for ten measured balls was determined.

Compressive Deformations of Core and Ball (BC)

A sphere (i.e., a core or a ball) was placed on a hard plate and the compressive deformation of the sphere when subjected to a final load of 130 kgf from an initial load of 10 kgf was measured. The compressive deformation refers in each case to a measured value obtained after holding the test specimen isothermally at 23.9° C. The instrument used was a high-load compression tester available from MU Instruments Trading Corporation. Measurement was carried out with the pressing head moving downward at a speed of 4.7 mm/s.

Material Hardnesses (Shore D Hardnesses) of Envelope Layer, Intermediate Layer and Cover The resin materials for each of these layers were molded into sheets having a thickness of 2 mm and left to stand for at least two weeks, following which the Shore D hardnesses were measured in accordance with ASTM D2240.

Surface Hardnesses (Shore D Hardnesses) of Envelope Layer-Encased Sphere, Intermediate Layer-Encased Sphere and Ball Measurements were taken by pressing the durometer indenter perpendicularly against the surface of each sphere. The surface hardness of the ball (cover) is the measured value obtained at dimple-free places (lands) on the ball surface. The Shore D hardnesses were measured with a type D durometer in accordance with ASTM D2240.

TABLE 3

| | | Example | | Comparative Example | | | |
|---|---|---|---|---|---|---|---|
| | | 1 | 2 | 1 | 2 | 3 | 4 |
| Construction | | 3-layer cover, 1-layer core (4-piece) | 3-layer cover, 1-layer core (4-piece) | 3-layer cover, 1-layer core (4-piece) | 2-layer cover, 1-layer core (3-piece) | 2-layer cover, 1-layer core (3-piece) | 2-layer cover, 1-layer core (3-piece) |
| Cover | Formulation | (6) | (6) | (6) | (7) | (9) | — |
| | Material hardness (Shore D) | 62 | 62 | 62 | 59 | 46 | — |
| | Surface hardness (Shore D) | 68 | 68 | 68 | 65 | 52 | — |
| | Diameter (mm) | 42.70 | 42.70 | 42.70 | 42.70 | 42.70 | — |
| | Compressive deformation (BC) (mm) | 3.40 | 3.20 | 3.20 | 3.70 | 2.40 | 3.46 |
| | Thickness (mm) | 1.25 | 1.25 | 1.25 | 1.35 | 0.80 | |
| Intermediate layer | Formulation | (4) | (4) | (5) | (3) | (8) | — |
| | Material hardness (Shore D) | 57 | 57 | 51 | 47 | 64 | — |

TABLE 3-continued

| | | Example | | Comparative Example | | | |
|---|---|---|---|---|---|---|---|
| | | 1 | 2 | 1 | 2 | 3 | 4 |
| | Surface hardness (Shore D) | 63 | 63 | 57 | 53 | 70 | — |
| | Diameter (mm) | 40.20 | 40.20 | 40.20 | 40.00 | 41.05 | — |
| | Thickness (mm) | 1.30 | 1.30 | 1.30 | 1.35 | 1.20 | — |
| Envelope layer | Formulation | (1) | (1) | (2) | — | — | — |
| | Material hardness (Shore D) | 40 | 40 | 30 | — | — | — |
| | Surface hardness (Shore D) | 46 | 46 | 36 | — | — | — |
| | Diameter (mm) | 37.60 | 37.60 | 37.60 | — | — | — |
| | Thickness (mm) | 1.20 | 1.20 | 1.20 | — | — | — |
| Core | Formulation | A | B | C | D | E | — |
| | Surface hardness (Shore D) | 49 | 51 | 52 | 48 | 59 | — |
| | Center hardness (Shore D) | 29 | 31 | 32 | 36 | 42 | — |
| | Surface hardness (Shore C) | 75 | 78 | 79 | 74 | 88 | — |
| | Center hardness (Shore C) | 49 | 51 | 53 | 58 | 66 | — |
| | Core surface hardness - Core center hardness (Shore C) | 26 | 26 | 26 | 16 | 22 | — |
| | Diameter (mm) | 35.20 | 35.20 | 35.20 | 37.30 | 38.65 | 38.77 |
| | Compressive deformation (mm) | 4.70 | 4.35 | 4.20 | 4.30 | 2.95 | — |

Coefficients of Restitution (COR) for Core, Intermediate Layer-Encased Sphere and Ball The COR values for the golf ball were measured using an ADC Ball COR Durability Tester produced by Automated Design Corporation (U.S.). The tester fires the golf ball pneumatically at an initial velocity of 35 to 55 m/s. A velocity measuring sensor is positioned at a distance of about 0.8 meter. When the golf ball strikes a metal plate positioned about 1.2 meters away, it rebounds in such a way as to pass by the velocity sensor. The COR value is the value obtained by dividing the return velocity by the initial velocity. The intermediate layer-encased sphere and the core were measured in the same way as the golf ball. The COR values for these respective spheres at given initial velocities are shown in Table 4 below.

TABLE 4

| Test sphere | Initial velocity conditions | Symbol or formula | Example 1 | Example 2 | Comparative Example 1 | Comparative Example 2 | Comparative Example 3 | Comparative Example 4 |
|---|---|---|---|---|---|---|---|---|
| Finished ball | COR: 35 m/s | (LBS) | 0.827 | 0.828 | 0.828 | 0.818 | 0.831 | 0.825 |
| | COR: 45 m/s | (MBS) | 0.782 | 0.786 | 0.784 | 0.767 | 0.794 | 0.775 |
| | COR: 55 m/s | (HBS) | 0.737 | 0.744 | 0.740 | 0.716 | 0.757 | 0.725 |
| Intermediate layer | COR: 35 m/s | (LMS) | 0.825 | 0.826 | 0.820 | 0.803 | 0.842 | 0.814 |
| | COR: 45 m/s | (MMS) | 0.777 | 0.779 | 0.771 | 0.748 | 0.802 | 0.749 |
| | COR: 55 m/s | (HMS) | 0.729 | 0.732 | 0.722 | 0.693 | 0.762 | 0.684 |
| Core | COR: 35 m/s | (LCS) | 0.805 | 0.814 | 0.815 | 0.803 | 0.832 | 0.808 |
| | COR: 45 m/s | (MCS) | 0.747 | 0.756 | 0.758 | 0.745 | 0.781 | 0.748 |
| | COR: 55 m/s | (HCS) | 0.689 | 0.698 | 0.701 | 0.687 | 0.730 | 0.688 |
| Finished ball | Formula (1) | {(LBS) + (MBS)} × (BC) | 5.47 | 5.16 | 5.16 | 5.86 | 3.90 | 5.53 |
| Intermediate layer | Formula (2) | {(LMS) + (MMS)} × (BC) | 5.45 | 5.13 | 5.09 | 5.74 | 3.94 | 5.40 |
| Core | Formula (5) | {(MCS) + (LCS)} × (BC) | 5.27 | 5.03 | 5.03 | 5.73 | 3.87 | 5.38 |
| Finished ball | Formula (3) | {(MBS) + (HBS)}/(LBS) × (BC) | 6.25 | 5.91 | 5.89 | 6.71 | 4.48 | 6.28 |
| Intermediate layer | Formula (4) | {(MMS)+ (HMS)}/(LMS) × (BC) | 6.21 | 5.85 | 5.83 | 6.64 | 4.46 | 6.08 |
| Core | Formula (6) | {(MCS) + (HCS)}/(LCS) × (BC) | 6.06 | 5.72 | 5.73 | 6.60 | 4.36 | 6.14 |

The flight performance and feel at impact of each golf ball were evaluated by the following methods. The results are shown in Table 6.

Flight Performance

A driver (W #1) was mounted on a golf swing robot and the distance traveled by the ball when struck under the conditions shown in Table 5 below was measured and rated according to the criteria in the table.

TABLE 5

| Driver | | W#1 | W#1 |
|---|---|---|---|
| Club used | Product name | PHYZ | PHYZ |
| | Conditions | HS, 45 m/s | HS, 35 m/s |
| Rating criteria | Good | ≥222.0 m | ≥176.0 m |
| | NG | ≤221.5 m | ≤175.7 m |

The club referred to in the above table as "PHYZ" was the PHYZ Driver (loft angle, 10.5°) manufactured by Bridgestone Sports Co., Ltd.

Feel

Sensory evaluations were carried out when the balls were hit with a driver (W #1) by amateur golfers having head speeds of 30 to 45 m/s. The "soft feel" and the "solid feel" of the balls were rated according to the following criteria.

(1) Rating Criteria for "Soft Feel"

Good: Twelve or more out of 20 golfers rated the ball as having a soft feel

Fair: From 7 to 11 out of 20 golfers rated the ball as having a soft feel

NG: Six or fewer out of 20 golfers rated the ball as having a soft feel (2) Rating Criteria for "Solid Feel"

Good: Twelve or more out of 20 golfers rated the ball as having a solid feel

Fair: From 7 to 11 out of 20 golfers rated the ball as having a solid feel

NG: Six or fewer out of 20 golfers rated the ball as having a solid feel

TABLE 6

| | | | Example | | Comparative Example | | | |
|---|---|---|---|---|---|---|---|---|
| | | | 1 | 2 | 1 | 2 | 3 | 4 |
| Flight | W#1 | Spin rate (rpm) | 2,710 | 2,760 | 2,770 | 2,700 | 2,970 | 2,705 |
| | HS, 45 m/s | Total distance (m) | 223.3 | 224.1 | 221.5 | 220.8 | 224.2 | 220.6 |
| | | Rating | good | good | NG | NG | good | NG |
| | W#1 | Spin rate (rpm) | 2,730 | 2,770 | 2,790 | 2,720 | 3,050 | 2,690 |
| | HS, 35 m/s | Total distance (m) | 177.5 | 176.3 | 176.0 | 177.0 | 175.6 | 176.5 |
| | | Rating | good | good | good | good | NG | good |
| Feel | Soft feel | Rating | good | good | good | good | NG | good |
| | Solid feel | Rating | good | good | fair | fair | good | NG |

As demonstrated by the results in Table 6, the golf balls of Comparative Examples 1 to 4 were inferior in the following respects to the golf balls according to the present invention that were obtained in the Examples.

In Comparative Example 1, the formula (2) value in Table 4 was lower than 5.10. As a result, the solid feel was inferior and the distance traveled by the ball when struck with a driver (W #1) at a head speed of 45 m/s was poor.

In Comparative Example 2, the formula (1) and formula (2) values in Table 4 were both greater than 5.50, and the LBS and LMS values were lower than 0.820. As a result, the solid feel was inferior and the distance traveled by the ball when struck with a driver (W #1) at a head speed of 45 m/s was poor.

In Comparative Example 3, the formula (1) and formula (2) values in Table 4 were both lower than 5.10. As a result, the soft feel was inferior and the distance traveled by the ball when struck with a driver (W #1) at a head speed of 35 m/s was poor.

In Comparative Example 4, the formula (1) value in Table 4 was greater than 5.50. As a result, the solid feel was inferior and the distance traveled by the ball when struck with a driver (W #1) at a head speed of 45 m/s was poor.

Japanese Patent Application No. 2018-245577 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A golf ball comprising a core, an intermediate layer and a cover wherein, letting LBS, MBS and HBS be the respective coefficients of restitution for the ball at incident velocities of 35 m/s, 45 m/s and 55 m/s, LMS, MMS and HMS be the respective coefficients of restitution for the sphere obtained by encasing the core with the intermediate layer (intermediate layer-encased sphere) at incident velocities of 35 m/s, 45 m/s and 55 m/s and BC be the compressive deformation (mm) of the ball when compressed under a final load of 1,275 N (130 kgf) from an initial load of 98 N (10 kgf), the ball satisfies formulas (1) and (2) below:

$$5.10 \leq (LBS+MBS) \times BC \leq 5.50 \quad (1)$$

$$5.10 \leq (LMS+MMS) \times BC \leq 5.50 \quad (2),$$

with the proviso that LBS≥0.820 and LMS≥0.820.

2. The golf ball of claim 1 wherein, letting LCS be the coefficient of restitution for the core at an incident velocity of 35 m/s, LCS≤0.815.

3. The golf ball of claim 1 wherein, letting MCS be the coefficient of restitution for the core at an incident velocity of 45 m/s, MCS≤0.756.

4. The golf ball of claim 1, wherein the coefficient of restitution for the ball satisfies formula (3) below:

$$5.90 \leq (MBS+HBS)/LBS \times BC \leq 6.50 \quad (3).$$

5. The golf ball of claim 1, wherein the coefficient of restitution for the intermediate layer-encased sphere satisfies formula (4) below:

$$5.85 \leq (MMS+HMS)/LMS \times BC \leq 6.50 \quad (4).$$

6. The golf ball of claim 1, wherein the core center and surface have a hardness difference therebetween on the Shore C hardness scale of at least 20.

7. The golf ball of claim 1 which satisfies the surface hardness relationship below:

Shore D hardness at cover surface>Shore D hardness at intermediate layer surface>Shore D hardness at core center.

8. The golf ball of claim 1 which has a construction of at least four layers that includes an envelope layer between the core and the intermediate layer.

9. The golf ball of claim 8 which satisfies the following relationship among surface hardness values:

Shore D hardness at cover surface>Shore D hardness at intermediate layer surface>Shore D hardness at envelope layer surface>Shore D hardness at core center.

10. The golf ball of claim 1, wherein MBS≥0.780 and MMS≥0.775.

11. The golf ball of claim 3 which satisfies formula (5) below:

$$5.00 \leq (MCS+LCS) \times BC \leq 5.35 \quad (5).$$

12. The golf ball of claim 3 which satisfies formula (6) below:

$$5.70 \leq (MCS+HCS)/LCS \times BC \leq 6.10 \quad (6).$$

* * * * *